US005476385A

United States Patent [19]

Parikh et al.

[11] Patent Number: 5,476,385

[45] Date of Patent: Dec. 19, 1995

[54] LASER SMALL ARMS TRANSMITTER

[75] Inventors: Himanshu N. Parikh, San Diego; Fritz W. Healey, Carlsbad, both of Calif.

[73] Assignee: Cubic Defense Systems, Inc., San Diego, Calif.

[21] Appl. No.: 415,595

[22] Filed: Apr. 3, 1995

Related U.S. Application Data

[62] Division of Ser. No. 237,717, Apr. 29, 1994, Pat. No. 5,410,815.

[51] Int. Cl.[6] ..... F41F 27/00

[52] U.S. Cl. ..... 434/22

[58] Field of Search ..... 434/21, 22; 273/310

[56] References Cited

U.S. PATENT DOCUMENTS

| | | | |
|---|---|---|---|
| 3,612,949 | 10/1971 | Becraft et al. | 33/286 |
| 4,530,162 | 7/1985 | Forrest et al. | 33/228 |
| 4,712,885 | 12/1987 | Dawson et al. . | |
| 4,899,039 | 2/1990 | Taylor et al. . | |
| 5,001,836 | 3/1991 | Cameron et al. | 33/234 |
| 5,031,349 | 7/1991 | Vogel | 356/153 |
| 5,060,391 | 10/1991 | Cameron et al. | 33/234 |
| 5,222,302 | 6/1993 | DeBatty et al. | 33/234 |
| 5,410,815 | 5/1995 | Parikh et al. | 33/234 |

*Primary Examiner*—William H. Grieb
*Attorney, Agent, or Firm*—Baker, Maxham, Jester & Meador

[57] ABSTRACT

A laser small arms transmitter (SAT) which may be affixed to the stock of a rifle such as an M16 used by a soldier in training with a multiple integrated laser engagement system (MILES). The transmitter includes a housing assembly having a forward end with a window through which the beam of a laser diode is emitted. A pair of optical wedges are positioned inside the housing assembly between the laser diode and the window. The optical wedges are supported for independent rotation about a common optical axis for steering the laser beam. An alignment head may be physically mated to the rearward end of the housing assembly for driving a pair of shafts to rotate the optical wedges in the alignment of the transmitter so that a soldier can accurately hit a target once he or she has located the target in the conventional sights of the rifle. The laser transmitter may also include a sensor for detecting the firing of a blank cartridge, a fire LED mounted inside the housing for producing an optical signal to indicate to the alignment head that the laser diode has been energized, and an inductive switch connected to a power circuit and actuable by an induction coil in the alignment head to energize the laser diode.

20 Claims, 5 Drawing Sheets

LASER SMALL ARMS TRANSMITTER

CROSS-REFERENCE TO RELATED APPLICATION

This application is a division of our U.S. patent application Ser. No. 08/237,717, filed Apr. 29, 1994 and entitled "Automatic Player Identification Small Arms Laser Alignment System", now U.S. Pat. No. 5,410,815, granted May 2, 1995.

BACKGROUND OF THE INVENTION

The present invention relates to military training equipment, and more particularly, to a laser transmitter mounted on a rifle for use by a soldier in war games.

For many years the armed services of the United States have trained soldiers with a multiple integrated laser engagement system (MILES). A laser small arms transmitter (SAT) is affixed to the stock of a rifle such as an M16. Each soldier carries detectors on his helmet and on a body harness adapted to detect a laser "bullet" hit. The soldier pulls the trigger of his or her rifle to fire a blank to simulate the firing of an actual round and an audio sensor triggers the SAT.

It is necessary to align the SAT so that the soldier can accurately hit the target once he or she has it located in the conventional rifle sights. In the past an early version of the SAT was bolted to the rifle stock and the mechanical sights of the weapon were adjusted to align with the laser beam. The disadvantage of this approach is that the mechanical weapon sights must be readjusted in order to use the rifle with live rounds. To overcome this disadvantage the conventional SAT now in use incorporates mechanical linkages for changing the orientation of the laser.

The prior art small arms alignment fixture (SAAF) used by the U.S. Army for alignment of the conventional MILES SAT consists of a complex array of one hundred forty-four detectors which are used in conjunction with thirty-five printed circuit boards to determine where the laser hits with respect to a target reticle. The difficulty in using the prior art SAAF is that the soldier aims his or her weapon at the array which is twenty-five meters away without the use of a stable platform. In many cases, the soldier fires his or her weapon in a manner which results in the aim point not being at the desired location. The fact that the array is located twenty-five meters away from the soldier introduces visibility limitations due to snow, fog, wind and poor lighting conditions at sunrise or dusk.

The prior art SAAF calculates the number of error "clicks" in both azimuth and elevation. The number of clicks is then displayed on the prior art SAAF using four sets of electro-mechanical display indicators. The soldier must then turn his conventional SAT's adjustors the corresponding number of clicks in the correct direction. He or she must then aim and fire the weapon again and make additional corresponding adjustments. This iterative process continues until the soldier obtains a zero indication on the prior art SAAF. This is a very time consuming and tedious process due to normal aiming errors incurred each time the soldier has to reacquire the target reticle. It is not uncommon for a soldier to take fifteen minutes to align his or her weapon to the best of his or her ability and still not have it accurately aligned.

Not only is the alignment process utilizing the prior art SAAF time consuming, it also expensive because a large amount of blank ammunition must be used. The laser of a conventional SAT will not fire without a blank cartridge being ignited or by using a special dry fire trigger cable. The prior art SAAF does not support optical sights, different small arms weapon types, nor night vision devices. Nor does the prior art SAAF accurately verify the laser beam energy and encoding of the received laser beam.

It would therefore be desirable to provide an improved SAT which would eliminate the need to utilize a large target array. Such a SAT would also preferably be automatically adjustable for more rapid and accurate alignment. In addition, preferably the laser output of the improved SAT could have different powers and codings to enable the manworn portion of a MILES system to discriminate between hits made by different small arms.

SUMMARY OF THE INVENTION

Accordingly, it is the primary object of the present invention to provide an improved laser small arms transmitter for use in a multiple integrated laser engagement system.

The present invention provides a laser transmitter that can be mounted to a small arms weapon. The laser transmitter has a laser energizable to emit a laser beam generally along the aim of the weapon. An alignment head of an electromechanical alignment system is connectable to the laser transmitter for adjusting the transmitter to steer the laser beam in azimuth and elevation until the laser beam is substantially aligned with a boresight of the weapon.

DETAILED DESCRIPTION OF THE PREFERRED EMBODIMENT

Figure 1A:
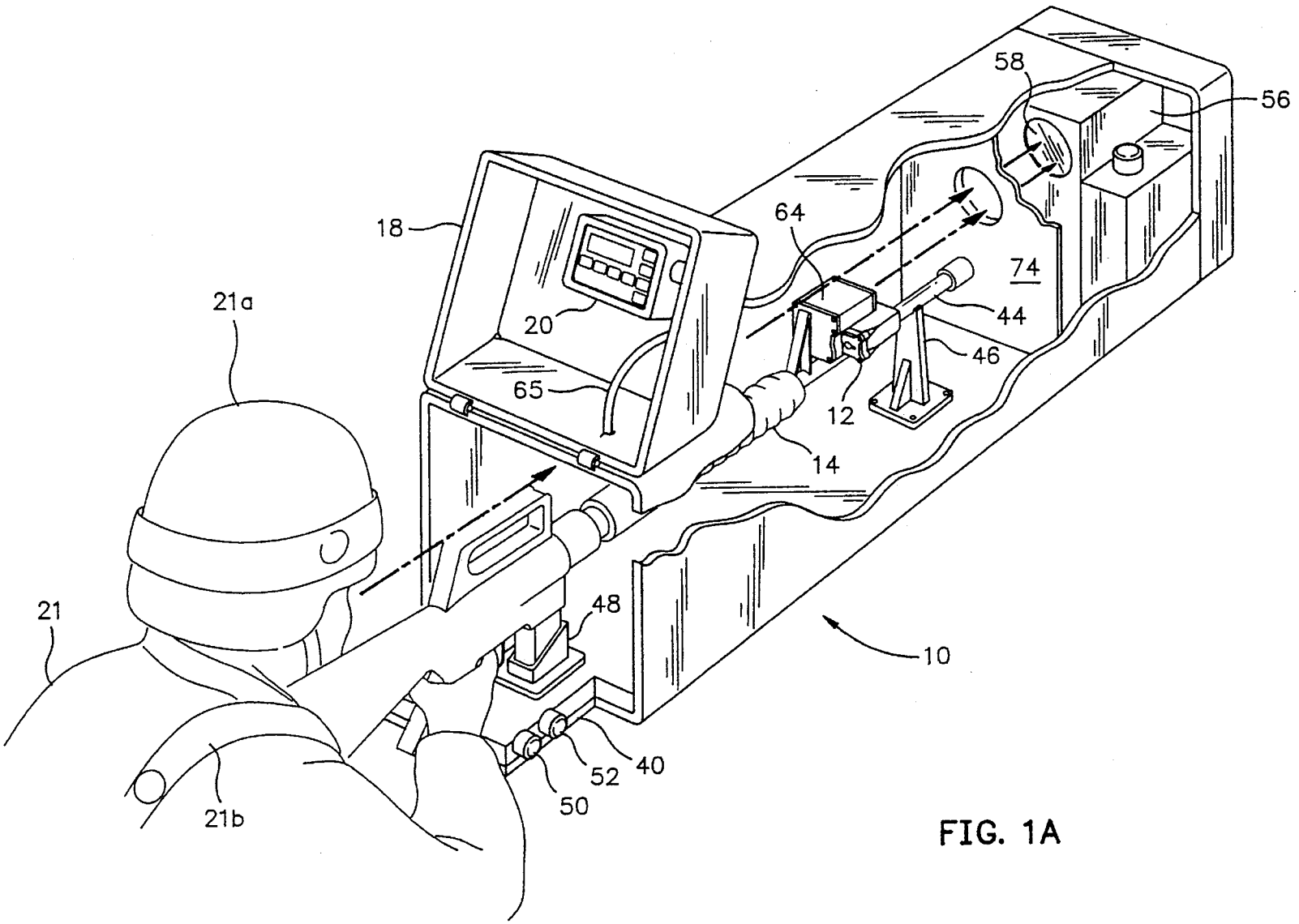
FIG. 1A is a perspective view of a soldier aiming his or her rifle in an automatic player identification small arms laser alignment system.
Figure 1B:
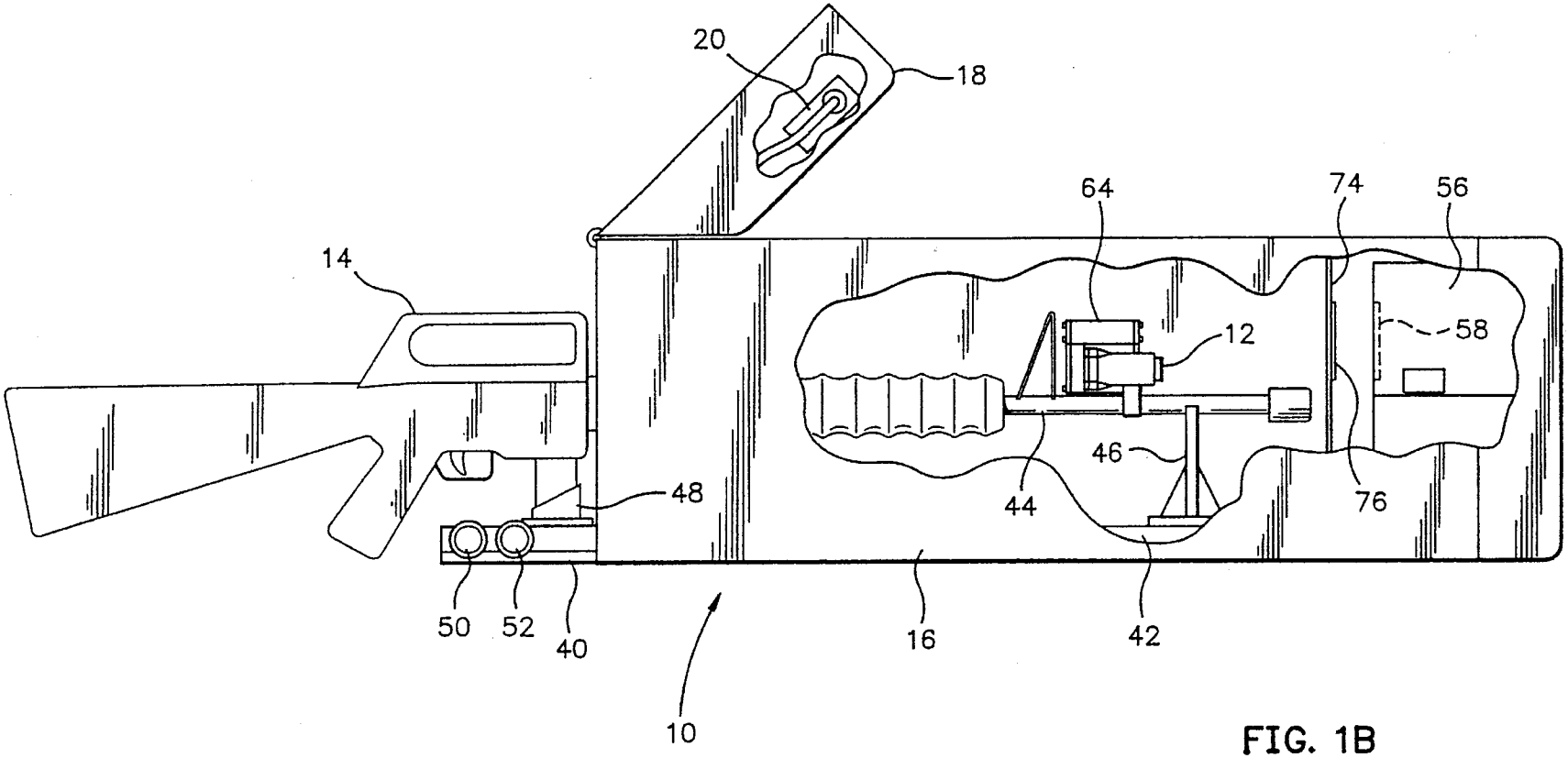
FIG. 1B is a side elevation view of the alignment system of FIG. 1A with portions broken away to reveal further details.
Figure 2:
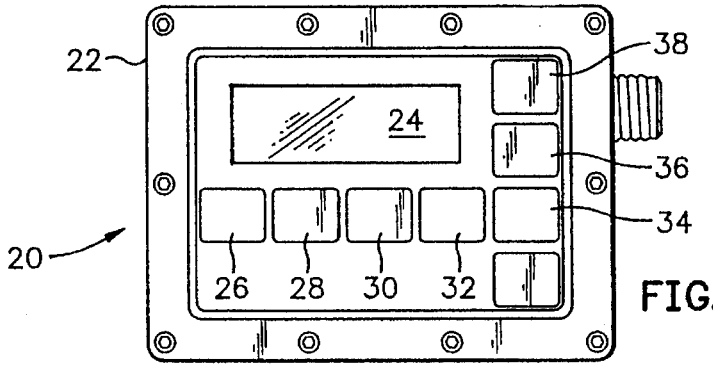
FIG. 2 is an enlarged front elevation view of the display panel and switches of the control unit of the alignment system of FIG. 1A and 1B.

Referring to FIG. 1A and 1B, the preferred embodiment of our invention is illustrated in the form of a laser small arms transmitter (SAT) 12 bolted to the stock of a small arms weapon 14 such as an M16 rifle for subsequent use by a solder in war games. Our SAT 12 is designed to be automatically adjusted by an alignment system 10 which includes a rectangular hollow transit case 16 which is horizontally oriented when in use. A lockable hinged end cover 18 of the case 16 may be swung upwardly to reveal a control unit 20 mounted to the inside thereof. A soldier 21 aims the weapon 14 inside the case 16. The soldier 21 wears a helmet 21*a* and a harness 21*b* equipped with laser detectors which detect laser "bullet" hits in subsequent war games. The control unit 20 includes a box-like housing 22 (FIG. 2) having an LCD display 24. The housing 22 also has a keypad in the form of a membrane switch panel. This switch panel surrounds the display 24 and includes pressure-type switches 26, 28, 30, 32, 34, 36 and 38.

A retractable sliding rack 40 may be extended horizontally from the rear end of a base unit 42 (FIG. 1B) mounted to the bottom wall of the case 16. A barrel 44 of the rifle 14 is firmly supported on the apex of a rigid triangular weapon rest 46 whose base is securely mounted via bolts to an intermediate portion of the base unit 42. A trigger guard (not visible) of the rifle 14 is mounted in a vise 48 on the rack 40. The vise 48 has knobs 50 and 52 for manually adjusting the azimuth and elevation, respectively, of the barrel 44 of the rile 14. After mounting the rifle 14 on the weapon rest 46 and vise 48, the soldier 21 (FIG. 1A) aims at an image of a target reticle 54 (FIG. 6) projected in the line of sight of the weapon as hereafter described in detail.

A box-shaped optics unit 56 (FIGS. 1A and 1B) is rigidly mounted on the forward portion of the base unit 42 (FIG. 1B). The optics unit 56 includes a convex lens 58 (FIG. 6) and a beam splitter 60. The beam splitter 60 is transparent to infrared light from the SAT 12 but reflective to visible light. The target reticle 54 (FIG. 6) is mounted inside the optics unit 56 below the axis of the laser beam. The beam splitter 60 is positioned forward of the lens 58 and is angled at forty-five degrees to project the image V of the target reticle through the lens 58 at infinity. A position sensor detector 62 in the optics unit 56 receives the laser beam L2 and generates an error signal representative of a displacement between a received location of the laser beam and the image of the target reticle. The SAT 12 is then adjusted until its laser beam L2 strikes the center of the detector 62.

Figure 3:
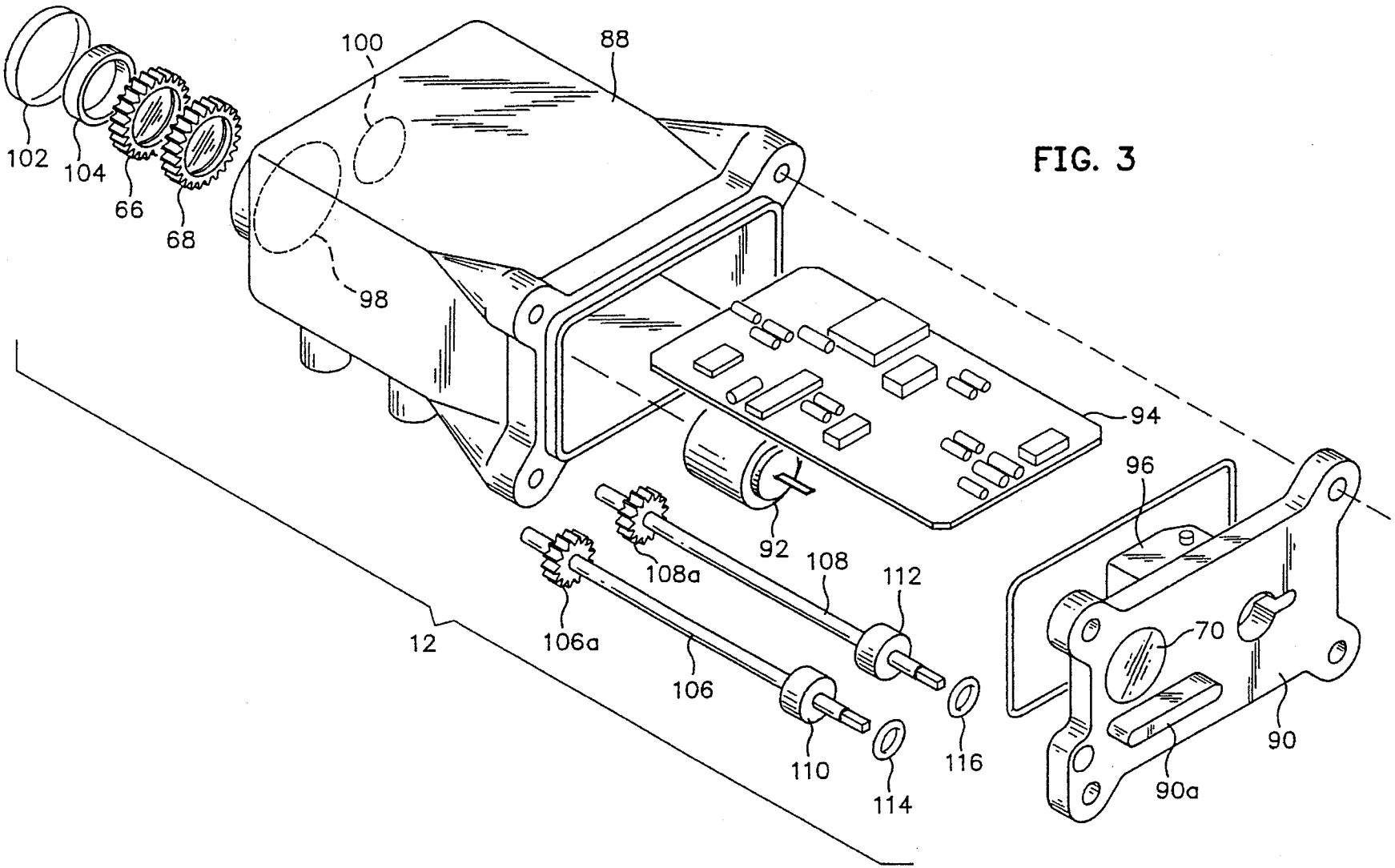
FIG. 3 is an enlarged exploded perspective view of a preferred embodiment of our small arms transmitter (SAT) which is mounted on the rifle shown in FIG. 1A and 1B.

A control circuit inside the control unit 20 (FIG. 1 ) is connected to an alignment head 64 which is mechanically coupled with a rear end of the SAT 12 bolted to the rifle 14. The control circuit causes the alignment head 64 to repetitively trigger the laser in the SAT 12. Utilizing the error signal, the control circuit causes the alignment head to independently rotate a pair of wedge prisms 66 and 68 (FIG. 3), each including a surrounding spur gear, in the SAT 12 to steer the laser beam in azimuth and elevation until the laser beam is substantially aligned with a boresight of the barrel 44 of the weapon.

The alignment system 10 may be used for the automatic boresight alignment of all U.S. military specified small arm weapons and machine guns with unlimited adaptability to new weapons. The automatic operation of the system assures rapid (less than one minute), accurate and consistent boresighting of the SAT 12 after a single initial sighting of the weapon 14 by the soldier 21. Use of the sighting vise 48 assures that optical sights and night vision devices on the weapon 14 will not interfere with the boresighting process. The entire alignment system 10 is contained within the rugged transit case 16 which also serves as a sun and foul weather shield. The alignment system 10 does not use blank ammunition during the alignment process and therefore it may be used at any location such as indoors on a table top.

The initial set up of the alignment system 10 involves three simple steps which include installation of battery into the control unit housing 22 (FIG. 1 ), activating the BIT switch 30 (FIG. 2) and selecting the weapon type to be aligned by depressing the switch 34. The display 24 will give appropriate text messages and directions to the operator as to how to proceed to the next step. Once the alignment system 10 is ready for alignment the soldier 21 follows the directions on the display 24 to align his or her weapon. The typical sequence is as follows:

a) The soldier attaches the alignment head 64 to the laser small arms transmitter (SAT) 12;

b) The soldier places his or her weapon in the sight vise 48 and front weapon rest 46;

c) The soldier aims his or her weapon at the image of the illuminated target reticle 54 visible in the optics unit using the sighting vise azimuth and elevation adjustment knobs 50 and 52;

d) The soldier depresses the proceed switch 28 (FIG. 2) and follows the instructions on the display 24. The weapon type is selected by depressing the switch 34 at the appropriate time in response to a query on the display;

e) The soldier backs away and depresses the align switch 26 on the control unit housing 22;

f) The soldier waits for an "ALIGNMENT COMPLETE" message on the display 24 which will occur less than one minute later; and g) The soldier removes the weapon from the alignment system following an alignment completion instruction.

In the event any problems are encountered by the alignment system 10 during the alignment process such as low power, incorrect laser coding or triggering problems, the system will inform the soldier that the weapon's SAT 12 is defective and needs to be replaced.

Figure 7:
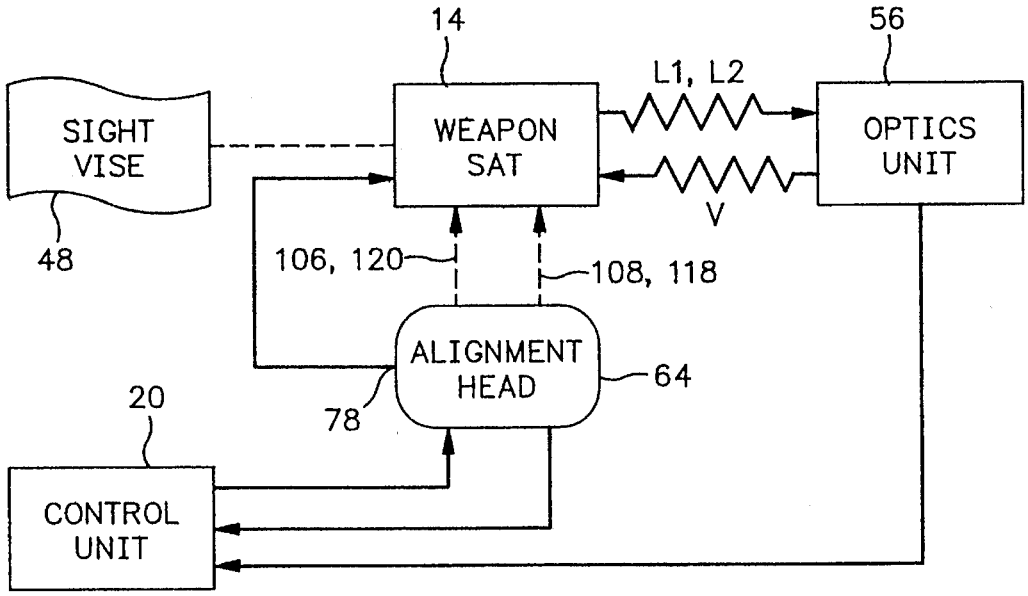
FIG. 7 is an overall block diagram of the alignment system of FIG. 1A and 1B.

The overall operation of the alignment system 10 is illustrated in the block diagram of FIG. 7. The weapon 14 is mounted in the sight vise 48 with the alignment head 64 attached to the SAT 12. The optics unit 56 includes the illuminated target reticle 54 at which the weapon's sights are aimed. When the align switch 26 (FIG. 2) is activated the control unit 20 causes the SAT 12 to be repetitively triggered while monitoring the SAT's fire LED (not illustrated) mounted behind a window 70 (FIG. 3) indicator for proper operation. The optics unit 20 senses the location of the laser and sends that data to the control unit 20 which in turn determines the amount of correction needed. The control unit 20 in turn causes the alignment head 64 to make the necessary adjustments to the SAT 12. The process continues in real time until the SAT 12 is precisely aligned. The control unit 20, in conjunction with the optics unit 56, also checks for laser power levels, laser codes and that the SAT's alignment optics are performing as desired. The five major sub-assemblies of the alignment system 10 are discussed in further detail hereafter.

Figure 6:
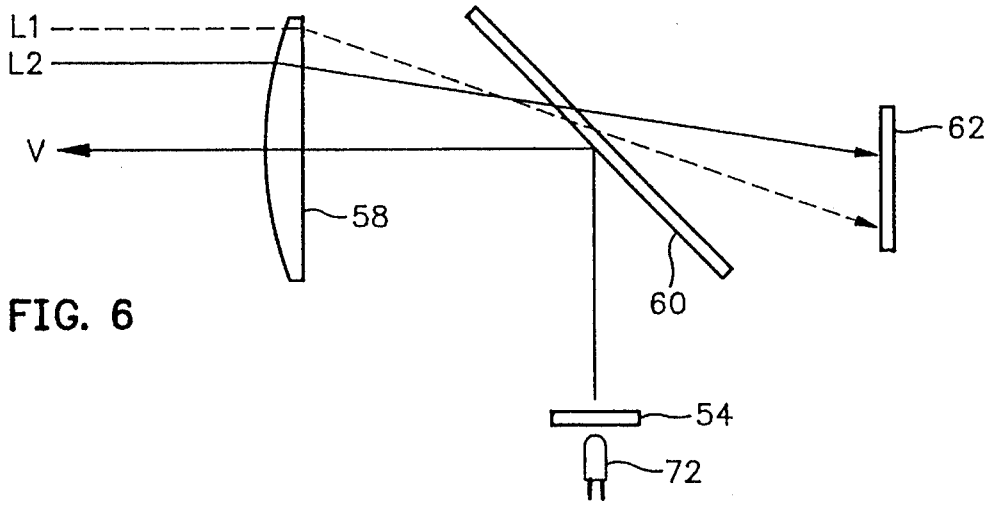
FIG. 6 is a diagrammatic illustration of the lens, beam splitter, target reticle and position sensor detector of the optics unit of the alignment system of FIG. 1A and 1B.

The optics unit 56 (FIGS. 1B) is the assembly which projects the illuminated target reticle 54 to the soldier 21 during boresighting and senses the location of the weapon's laser beam with respect to the reticle. The illuminated reticle 54 assists the soldier 21 in boresighting during reduced lighting conditions such as dusk or dawn. FIG. 6 illustrates the operation of the principal components of the optics unit 56. The single large convex lens 58 serves the function of collimating and focusing the laser beam to a spot at the longitudinal position sensor detector 62 which is located at the focal point of the lens 58. When the angle of incidence to the lens 58 of the laser beam is not perpendicular (mis-aligned) the position of the spot on the detector 62 is offset. The detector 62 passively quantifies the amount of offset and sends the error to the control unit 20. The detector is preferably a solid state device such as a quad-detector or it may be a linear detector with an analog output. Within the path of the laser beam is the beam splitter 60 which is reflective to visible light while allowing the infrared light from the laser to pass through the same. The beam splitter 60 is supported at a forty-five degree angle to project an image of the target reticle 54 through the same lens as the incoming laser. The sighting target reticle 54 is illuminated by a visible light source such as an LED 72 and is positioned such that the projected image is on the same optical axis as the zero point of the position sensor detector 62. No field adjustments of the optics unit 56 are required and the system 10 need not contain any electronics other than the detector 62 and the LED light source 72 for illuminating the target reticle 54.

An L-shaped protective barrier 74 (FIG. 1 ) is rigidly secured via bolts to the base unit 42 between the tip of the barrel 44 of the weapon and the optics unit 56. It prevents the soldier from inadvertently striking the lens 58 of the optical unit with the barrel 44 when mounting the rifle 14 on the weapon rest 46 and vise 48. The barrier has a hole therethrough covered by a metal screen 76 for allowing the laser beam, which may be eight millimeters wide to pass through the same to the optics unit 56. Glass or some other solid transparent covering for the hole may not be desirable because it could become dirty, attenuate the laser beam, or deflect the laser beam and thereby introduce inaccuracies.

Figure 5A:
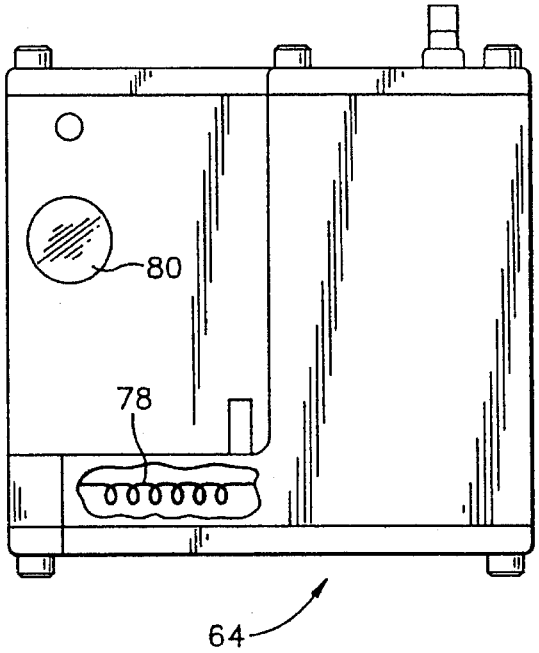
FIG. 5A and 5B are side and front elevation views of the alignment head of the alignment system of FIGS. 1A and 1B.
Figure 5B:
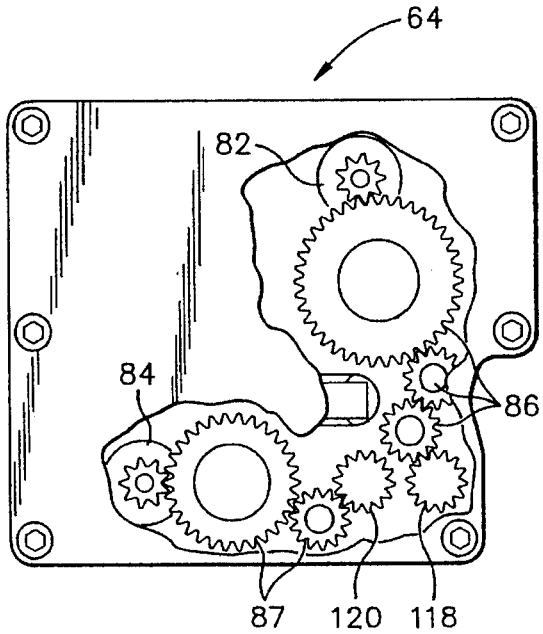

The alignment head 64 (FIGS. 5A and 5B) is an electromechanical device which is attached to the SAT 12 via a cable 65 (FIG. 1A) and automatically adjusts the SAT's laser position as directed by the control unit 20. The alignment head 64 contains an inductive coil 78 (FIG. 5A) which is used to trigger the SAT's laser and if requested via switch 30 (FIG. 2) transfers a testing player identification (PID) to the SAT. The head 64 also has a detector 80 which monitors the SAT's fire LED 70 to determine its operational status. Two miniature reduction geared motors 82 and 84 (FIG. 5B) and an associated offset gear trains 86 and 87 within the alignment head 64 are used to rotate non-slip couplings (not visible) on a pair of geared shafts 118 and 120. The couplings .fit over the ends of the SAT's adjustment shafts 106 and 108. The alignment head motors 82 and 84 are driven and controlled by the control unit 20 during the boresighting process while the optics unit 56 senses the SAT's laser and provides real time feedback to the control unit 20.

The laser small arms transmitter (SAT) 12 (FIG. 3) includes a housing assembly 88 with a removable cover assembly 90 which forms a rear end thereof. A laser diode assembly 92 is mounted within the housing assembly 88 and is energized by a power circuit on a controller board 94 also mounted within the housing assembly 88. The power circuit is actuated to energize the laser diode assembly 92 by an inductive switch 96 mounted to the inside of the rear cover assembly 90. The inductive switch is actuated by energization of the induction coil 78 (FIG. 5A) which overlaps the top on the housing assembly 88 (FIG. 3) in alignment with the inductive switch 96.

The forward end of the SAT housing assembly 88 (FIG. 3) is formed with holes 98 and 100. An audio or optical sensor (not illustrated) for detecting the firing of a blank cartridge is located in the hole 100 and connected to the circuit on the controller board 94. A transparent window 102 for permitting passage of the beam from the laser diode assembly 92 is mounted in the other window 98. An optical sleeve 104 is positioned behind the window 102. The optical wedges 66 and 68 are rotably supported behind the window 102 for independent rotation via drive shafts 106 and 108, respectively. The forward ends of these shafts have pinion gears **106*a* and 108*a* for engaging toothed peripheral (spur gear) portions of the optical wedges 66 and 68, respectively. The drive shafts 106 and 108 are journaled in bearings such as 110 and 112. The rear ends of the drive shafts 106 and 108 extend through holes (not visible) in the rear cover assembly 90 which are sealed by O-rings 114 and 116. These shaft ends are protected by a rigid flange 90*a* that extends perpendicularly from the rear cover assembly 90. When the alignment head 64 (FIGS. 5A and 5B) is coupled to the rear cover assembly 90 of the SAT 12, the non-slip couplings (not visible) on the geared shafts 118 and 120 (FIG. 5B) of the alignment head 64 connect with the ends of the shafts 106 and 108 to provide driving connections to the motors 82 and 84**.

Figure 4:
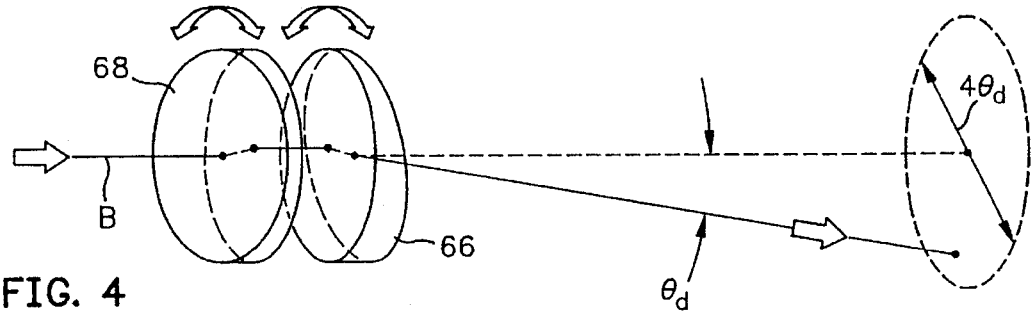
FIG. 4 is a diagrammatic illustration of laser beamsteering using optical wedges.

FIG. 4 illustrates diagrammatically the steering of the laser beam B by independent rotation of the optical wedges 66 and 68 via motors 82 and 84 of the alignment head 64. Optical wedges may be used as beamsteering elements in optical systems. The minimum deviation or deflection experienced by a ray or beam in passing through a thin wedge of apex angle $\theta_w$ is approximately given by $\theta_d=(n-1)\,\theta_w$, where n is the reflective index. The "power" ($\Delta$) of a prism is measured in prism diopters, a prism diopter being defined as a deflection of 1 cm at a distance of one meter from the prism. Thus $\Delta=100\tan(\theta_d)$. By combining two wedges of equal power (equal deviation) in near contact, and independently rotating them about an axis roughly parallel to the normals of their adjacent faces, a laser beam B passing through the combination can be steered in any direction, within a narrow cone, about the path of the undeviated beam. The angular radius of this cone is approximately $\theta_d$. Apex angle is controlled to within very tight tolerances in the manufacturing process of the wedges. As a result of the melt-to-melt index tolerance, deviation angles (functions of wave-length) are nominally specified.

The deviation angles are specified with the assumption that the input beam is normal to the perpendicular face. At other input angles the deviation will, of course, be different. To determine the deviation angle for the same input direction but other wavelengths, the equation is: $\theta_d=\arcsin(n \sin \theta_w)-\theta_w$, where $\theta_d$ is the deviation angle, $\theta_w$ is the wedge angle and n is the nominal index at the appropriate wavelength. Optical wedges are available in various materials, such as synthetic fused silica, and in different shapes and sizes.

The control unit 20 (FIG. 1A) provides the user-friendly LCD display 24 (FIG. 2) and controls which continuously inform the user of his weapon status while progressively instructing him throughout the alignment process. The control unit 20 is mounted inside the transit case cover 18. The LCD display 24 can be easily read when the cover 18 is in raised open position. As described above the control unit 20 provides all controls and monitors all activities of the optics and alignment head units 56 and 64. The front membrane switch panel with its integral 4×20 LCD display 24 provides the user interface. The switch functions are described as follows:

a) ALIGN (26) —This switch is activated by the soldier after he or she has aimed the weapon's sights at the optics units target reticle.

b) PROCEED (28) —This switch is activated any time the soldier desires to move to the next alignment step or to acknowledge a displayed message.

c) BIT (30) —This switch is activated during initial setup of the system to verify its ready status.

d) PID LEARN (32) —This switch is used to transfer the system's test PID to the SAT 12 in order to verify that the transfer function operators. Use of this switch is optional and is only used if there is some question as to the SAT of the cradled weapon being able to accept other PIDs.

e) WEAPON SELECT (34) —This switch is used in conjunction with the two arrow switches 36 and 38 to select the type of weapon to be aligned (M16A2, M2, M240 etc.). This selection determines which power levels and codes are to be verified by the system.

f) ARROWS (36 and 38) —These switches are used to select the different weapon types.

The sighting vise 48 (FIG. 1B) is a stable mechanism used to hold and aim the weapon 14 under alignment. It allows the soldier to boresight using any aiming bias introduced by his method of aiming and eliminates any weapon wandering away from the aim point. The vise 48 is attached to the sliding rack 40 which retracts into the transit case base unit 42 to accommodate the different lengths of weapons. The sight vise 48 has both elevation and azimuth adjustment knobs 50 and 52 allowing the soldier to accurately aim his weapon's sights at the image of the target reticle 54. The front portion of the weapon barrel 44 rests on the weapon rest 46 located within the transit case 16 on the transit case base unit 42.

The major components of the alignment system 10 are integral to the transit case 16 which provides a secure and rugged environment during transport and operation. The case 16 also provides a sun and foul weather shield to allow the alignment process to be accomplished in any expected environment. The base unit 42 is mounted on the bottom wall of the case. The optics unit 56, weapon rest 46 and sliding sight vise rack 40 are attached to the base unit battery (not visible) for powering the system is housed inside the base unit 42. The control unit 20 is attached to the inside of the front cover 18A.

Figure 8:
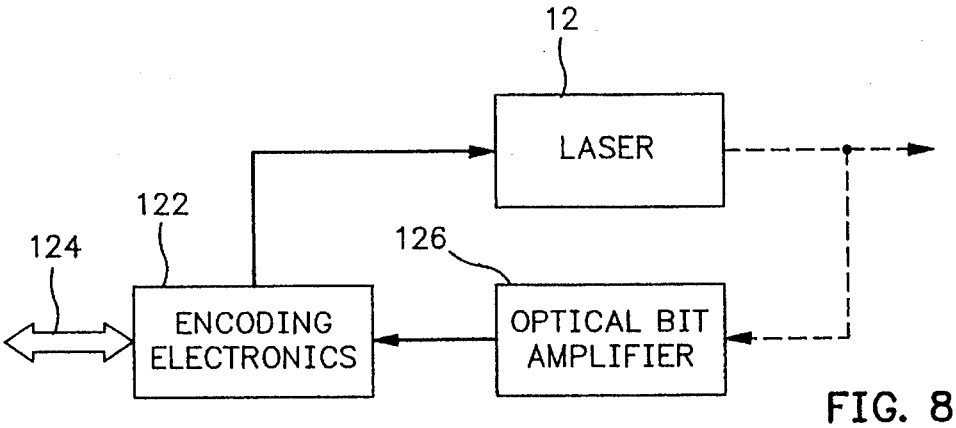
FIG. 8 is a block diagram of the optical output power and code accuracy verification circuit of the control unit of the alignment system of FIG. 1A and 1B.

FIG. 8 is a block diagram of the optical output power and code accuracy verification circuit of the control unit 20. An encoding circuit 122 is connected via a serial data bus 124 to a microcomputer (not illustrated). An optical bit amplifier 126 in the path of the laser beam outputs signals to the encoding electronics.

While we have described a preferred embodiment of our laser small arms transmitter and its automatic adjustment by an alignment system, it will be apparent to those skilled in the art that our invention can be modified in both arrangement and detail. Therefore, the protection afforded our invention should only be limited in accordance with the following claims.

What is claimed is:

1. A laser transmitter for mounting to a small arms weapon to simulate the firing of an actual round, comprising:

a housing assembly having a forward end with a window;

a laser diode mounted inside the housing assembly for emitting a laser beam through the window;

a power circuit mounted in the housing assembly and connected to the laser diode for energizing the diode to cause it to emit the laser beam;

first and second optical wedges positioned between the laser diode and the window;

means for supporting the first and second optical wedges for independent rotation about a common optical axis for steering the laser beam; and drive means connected to the optical wedge supporting means having portions extending through the housing assembly for coupling to an alignment head.

2. A laser transmitter according to claim 1 wherein the optical wedges having substantially equal deviation.

3. A laser transmitter according to claim 1 wherein each optical wedge has a first face perpendicular to the common optical axis and a second face which extends at an angle relative to the common optical axis.

4. A laser transmitter according to claim 3 wherein the first and second optical wedges are supported with their first perpendicular faces in near contact.

5. A laser transmitter according to claim 1 wherein the means for supporting the first and second optical wedges includes first and second spur gears, each surrounding a corresponding one of the wedges.

6. A laser transmitter according to claim 5 wherein the drive means includes first and second adjustment shafts and first and second pinion gears mounted on corresponding ones of the adjustment shafts for engaging corresponding ones of the spur gears, and the adjustment shafts having ends which extend through a corresponding one of a pair of holes in a rearward end of the housing assembly for driving connection to the alignment head.

7. A laser transmitter according to claim 6 including a flange extending from the housing assembly adjacent the holes to protect the ends of the adjustment shafts which extend therethrough.

8. A laser transmitter according to claim 1 wherein the rearward end of the housing assembly has a second window and a fire LED mounted behind the second window.

9. A laser transmitter according to claim 1 wherein the transmitter further comprises a sensor for detecting the firing of a blank cartridge.

10. A laser transmitter according to claim 1 wherein the transmitter further comprises an inductive switch connected to the power circuit and actuable by an induction coil in the alignment head to energize the laser diode.

11. A laser transmitter for mounting to a small arms weapon to simulate the firing of an actual round comprising:

a housing assembly having a forward end with a first window;

a laser mounted inside the housing assembly for emitting a laser beam through the first window;

a power circuit mounted inside the housing assembly and connected to the laser for energizing the laser to cause it to emit the laser beam;

driveable means for steering the laser beam;

means for driving the steering means; and an inductive switch connected to the power circuit and actuable by an induction coil in an alignment head mountable on the housing assembly to energize the laser.

12. A laser transmitter according to claim 11 wherein the means for steering the laser beam includes first and second optical wedges positioned between the laser and the first window and means for supporting the first and second optical wedges for independent rotation by the driving means about a common axis.

13. A laser transmitter according to claim 11 wherein the housing assembly has a rearward end with a second window and a fire LED is mounted behind the second window inside the housing assembly.

14. A laser transmitter according to claim 11 wherein the housing assembly includes a hollow rectangular box and the rearward end of the housing assembly is a removable cover assembly.

15. A laser transmitter according to claim 12 wherein the optical wedges each have a first face perpendicular to the common optical axis and a second face which extends at an angle relative to the common optical axis.

16. A laser transmitter according to claim 15 wherein the first and second optical wedges are supported with their first perpendicular faces in near contact.

17. A laser transmitter according to claim 12 wherein the means for supporting the first and second optical wedges include the first and second spur gears each surrounding a corresponding one of the wedges.

18. A laser transmitter according to claim 17 wherein the driving means includes first and second adjustment shafts and first and second pinion gears mounted on corresponding ones of the adjustment shafts for engaging corresponding ones of the spur gears, the adjustment shafts having ends which extend through a rearward end of the housing assembly for driving connection to the alignment head.

19. A laser transmitter according to claim 11 wherein the forward end of the housing assembly includes a second window and the transmitter further comprises a sensor mounted behind the second window for detecting the firing of a blank cartridge.

20. A laser transmitter for mounting to a small arms weapon to simulate the firing of an actual round comprising:

a housing assembly having a forward end with a first window and a second window, and a rearward end with a third window;

a laser diode mounted inside the housing assembly for emitting a lapser beam through the first window;

a power circuit mounted in the housing assembly and connected to the laser diode for energizing the diode to cause it to emit the laser beam through the first window;

an inductive switch connected to the power circuit and actuable by an induction coil in an alignment head mountable to the housing assembly to energize the laser diode;

a sensor mounted inside the housing assembly behind the second window for detecting the firing of a blank cartridge;

a fire LED mounted inside the housing behind the third window for producing an optical signal to indicate to the alignment head that the laser diode has been energized;

first and second optical wedges positioned inside the housing assembly between the laser diode and the first window;

means for supporting the first and second optical wedges for independent rotation about a common optical axis for steering the laser beam; and drive means connected to the optical wedge supporting means having portions extending through the rearward end of the housing assembly for coupling to the alignment head.

* * * * *